US007308737B2

(12) United States Patent
Saitoh et al.

(10) Patent No.: US 7,308,737 B2
(45) Date of Patent: Dec. 18, 2007

(54) MAGNETICALLY ACTUATED LOCKING MECHANISM

(75) Inventors: Masatoshi Saitoh, Saitama (JP); Tohru Negishi, Saitama (JP)

(73) Assignee: Washin Optical Co., Ltd., Tokyo (JP)

( * ) Notice: Subject to any disclaimer, the term of this patent is extended or adjusted under 35 U.S.C. 154(b) by 12 days.

(21) Appl. No.: 11/343,790

(22) Filed: Jan. 31, 2006

(65) Prior Publication Data

US 2006/0174455 A1 Aug. 10, 2006

(30) Foreign Application Priority Data

Feb. 9, 2005 (JP) ..... 2005-064572

(51) Int. Cl.
*A44B 21/00* (2006.01)

(52) U.S. Cl. ..... 24/303

(58) Field of Classification Search ..... 292/251.5; 24/303; 70/276, 413
See application file for complete search history.

(56) References Cited

U.S. PATENT DOCUMENTS 2,475,226 A * 7/1949 Ellis ..... 24/303
4,622,726 A * 11/1986 Nakamura ..... 24/574.1
6,981,391 B2 * 1/2006 Suzuki ..... 63/3.1
7,152,282 B2 * 12/2006 Costa ..... 24/303
2006/0049645 A1 * 3/2006 Drumm ..... 292/251.5

* cited by examiner

*Primary Examiner*—Robert J. Sandy
(74) *Attorney, Agent, or Firm*—Carrier, Blackman + Associates, P.C.; Joseph P. Carrier; William D. Blackman

(57) ABSTRACT

A magnetically actuated locking mechanism includes a male section and a female section releasably coupled to the male section. The male section includes a male body, a projection extending from one end of the male body and including a transverse bore, and a locking element movable between an unlocked position wherein the locking element is received within the bore and a locked position wherein the locking element is partly extracted from the bore. A first magnet is embedded in the locking element. The female section includes a female body having a guide cavity dimensioned to receive the projection, and a transverse locking recess dimensioned to lockingly receive a part of the locking element as extracted. A second magnet is embedded in the female body adjacent to the locking recess. The first and second magnets have opposed polarities and are operatively associated with each other to magnetically urge the locking element from the unlocked position to the locked position when the locking element is aligned with the locking recess after the projection is inserted into the guide cavity.

16 Claims, 5 Drawing Sheets

MAGNETICALLY ACTUATED LOCKING MECHANISM

FIELD OF THE INVENTION

The present invention generally relates to locking devices and more particularly, to a magnetically actuated locking mechanism wherein a plurality of magnetic elements are operatively associated with each other so as to magnetically urge the locking mechanism from an unlocked to locked position.

BACKGROUND OF THE INVENTION

A wide variety of locking devices are employed in a toy, a cabinet, a bag or briefcase, an ornament, a seat belt and etc. One example of such a known locking device uses a spring to urge a locking element from its unlocked to locked position. Another locking device includes a latch mechanism. Generally, those known locking devices are complicated in structure and are difficult to operate.

It is, therefore, an object of the present invention to provide a magnetically actuated locking mechanism which is simple in structure and is easy to operate.

SUMMARY OF THE INVENTION

According to the present invention, there is provided a magnetically actuated locking mechanism including a male section and female section releasably coupled to the male section. The male section includes a male body, a projection extending from the male body and including a bore extending in a direction transverse to the direction in which the projection extends, and a locking element movable between an unlocked position wherein the locking element is received within the bore and a locked position wherein the locking element is partly extracted from the bore. The locking element includes at least one first magnetic element. The female section includes a female body having a guide cavity extending in a first direction and dimensioned to receive the projection, a locking recess extending in a second direction transverse to the first direction and dimensioned to lockingly receive the extracted part of the locking element, and at least one second magnetic element located adjacent to the locking recess. The first and second magnetic elements are operatively associated with each other to magnetically urge the locking element from its unlocked to locked position when the locking element is substantially aligned with the locking recess after the projection is inserted into the guide cavity.

In one embodiment, the first magnetic element and the second magnetic element are permanent magnets of opposite polarities. Alternatively, one of the first and second magnetic elements is a permanent magnet, and the other magnetic element is made of a ferromagnetic material.

In another embodiment, the projection includes at least one third magnetic element. The third magnetic element is attracted to the first magnetic element so as to hold the locking element in its unlocked position. The third magnetic element may be made of a ferromagnetic material, and the first and second magnetic elements may be in the form of permanent magnets of opposed polarities. As an alternative, the first magnetic element may be made of a ferromagnetic material, and the second and third magnetic elements may be permanent magnets, with the second magnetic element having a greater magnetic force than the third magnetic element. Still alternatively, the first magnetic element may be in the form of a permanent magnet, and the second and third magnetic elements may be permanent magnets having a polarity opposite to that of the first magnetic element, with the second magnetic element having a greater magnetic force than the third magnetic element.

In a further embodiment, the female body includes a through access opening through which the locking element held in its locked position is accessible from outside of the female body. The through access opening is less in diameter than the locking recess. A release pin or similar element may be used to push the locking element from its locked to unlocked position.

In one embodiment, the first magnetic element extends in a direction transverse to the direction in which the projection extends, when the locking element is held in its unlocked position. The first and second magnetic elements lie on a common straight line when the locking element is held in its locked position.

In one embodiment, two first magnetic elements are embedded in opposite sides of the locking element and extend in a direction substantially identical to the direction in which the projection extends. Also, two second magnetic elements are embedded in the female body and located at opposite sides of the locking recess. The two first magnetic elements are aligned with the respective two second magnetic elements so as to hold the locking element in its locked position.

In another embodiment, the male body has a flat end and an opposite end. The male body includes a through aperture in the opposite end. The female body has a flat end releasably connected to the flat end of the male body and an opposite end. The female body includes a through aperture in the opposite end. A rope or other elongated element may be used with the locking mechanism. To that end, opposite ends of the rope may be connected to the male and female bodies through the respective through apertures.

BRIEF DESCRIPTION OF THE DRAWINGS

The present invention may be best understood by reference to the following description when taken in conjunction with the accompanying drawings in which.

DETAILED DESCRIPTION OF THE PREFERRED EMBODIMENTS

Figure 1:
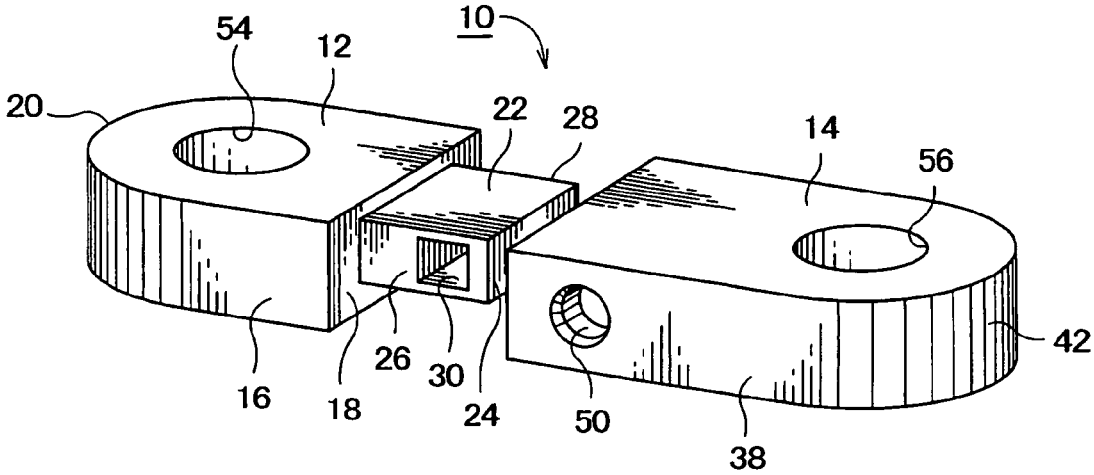
FIG. 1 is an exploded perspective view of a magnetically actuated locking mechanism according to one embodiment of the present invention, with a locking element removed for clarity.
Figure 2:
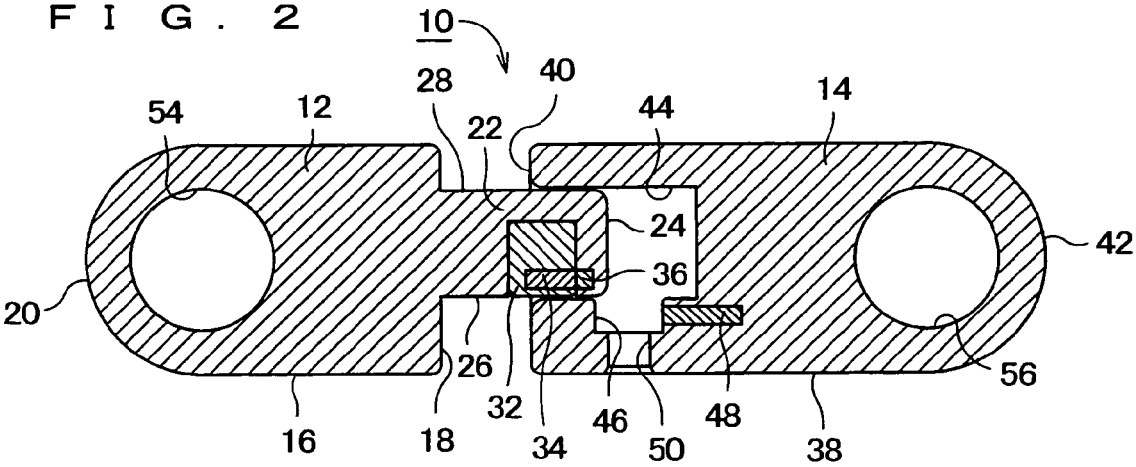
FIG. 2 is a sectional view of the locking mechanism, with a male section partly inserted into a female section.
Figure 3:
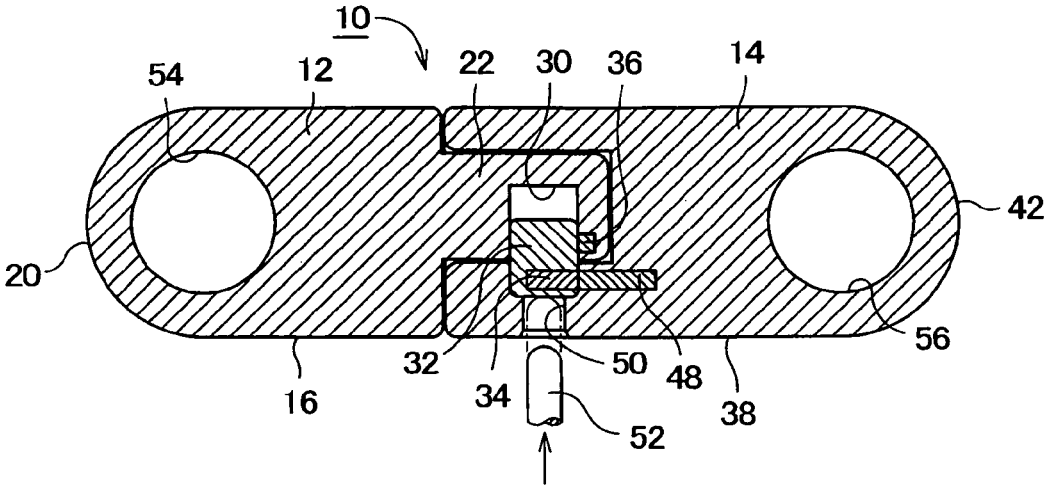
FIG. 3 is a view similar to that of FIG. 2, but showing that the male section is fully inserted into and securely coupled to the female section.

Referring now to FIGS. 1 to 3, there is illustrated a magnetically actuated locking mechanism, generally designated as at 10, according to one embodiment of the present invention. The locking mechanism 10 generally includes a male section 12 and a female section 14 releasably coupled to the male section 12.

The male section 12 includes a generally rectangular male body 16 with a flat end 18 and an opposite, round end 20. A rectangular projection 22 extends from the flat end 18 of the male body 16 and is less in width and thickness (or height) than the male body 16. The projection 22 has a free end 24. The projection 22 has opposite sides 26, 28 extending between the flat end 18 of the male body 16 and the free end 24 of the projection 22. A rectangular bore 30 is formed in the side 26 of the projection 22. The rectangular bore 30 extends in a direction substantially perpendicular to the direction in which the projection 22 extends. A rectangular locking element 32 (removed from FIG. 1 to show the inside of the bore 30) is slidably disposed in the bore 30 and is movable between an unlocked position wherein the locking element 32 is fully received within the bore 30 as shown in FIG. 2 and a locked position wherein the locking element 32 is partly extracted from the bore 30 as shown in FIG. 3. A thin rectangular magnetic element or permanent magnet 34 is embedded in the locking element 32 and extends in the direction in which the projection 22 extends, when the locking element 32 is received within the bore 30. The exposed outer end of the magnet 34 is substantially flush with the adjacent side surface of the locking element 32. To hold the locking element 32 within the bore 30, a magnetic element or permanent magnet 36 is embedded in the free end 24 of the projection 22. The exposed outer end of the permanent magnet 36 is substantially flush with the adjacent inner wall of the bore 30. The permanent magnet 36 has a polarity opposite to that of the permanent magnet 34. When the locking element 32 is placed in its unlocked position as shown in FIG. 2, the permanent magnet 36 is aligned with and faces against the permanent magnet 34 so as to hold the locking element 32 in place within the bore 30.

The female section 14 includes a generally rectangular female body 38 with a flat end 40 and an opposite, round end 42. A rectangular guide cavity 44 is formed in the female body 38 and extends from the flat end 40 toward the round end 42 of the female body 38. The guide cavity 44 is dimensioned to receive the entire projection 22 when the flat end 18 of the male body 16 is brought into contact with the flat end 40 of the female body 38. The open outer end of the guide cavity 44 is tapered to facilitate insertion of the free end 24 of the projection 22. A rectangular locking recess 46 is defined in one side of the guide cavity 44 and communicated with the guide cavity 44. The depth of the locking recess 46 is less than the length of the locking element 32 so that when the locking element 32 is placed in the locked position as shown in FIG. 3, the inner half of the locking element 32 remains in the bore 30 while the outer half of the locking element 32 fills the locking recess 46.

A magnetic element or permanent magnet 48 is embedded in the female body 38 adjacent the locking recess 46. The exposed outer end of the permanent magnet 48 is substantially flush with the adjacent inner wall of the locking recess 46. The magnet 48 has a polarity opposite to that of the magnet 34. The magnet 48 has the same polarity as the magnet 36, but has a greater magnetic or attractive force than the magnet 36. With this arrangement, when the free end 24 of the projection 22 reaches near the bottom of the guide cavity 44, the locking element 32 is brought into alignment with the locking recess 46 in a direction perpendicular to the direction in which the projection 22 is moved into the guide cavity 44. The magnet 34 is then attracted to the magnet 48 since the magnet 48 has a greater attractive force than the magnet 36. This causes the locking element 32 to be partly extracted from the bore 30 and received within the locking recess 46. In other words, the locking element 32 is automatically urged from its unlocked to locked position immediately after the projection 22 is fully inserted into the guide cavity 44.

Once the locking element 32 is partly inserted into and engaged with the locking recess 46, the male section 12 can not be disconnected from the female section 14. A through access opening 50 is defined in the female body 38 and extends between the locking recess 46 and the adjacent outer surface of the female body 38. To disconnect the male section 12 from the female section 14, a release pin 52 or similar element is used to push the locking element 32 in a direction as shown by the arrow in FIG. 3 until the locking element 32 is moved out of the locking recess 46 and fully received within the bore 30. This allows the male section 12 to be disconnected from the female section 14.

In the illustrated embodiment shown in FIGS. 1 to 3, all the magnetic elements 34, 36, 48 are in the form of permanent magnets. The invention is not limited to this embodiment. For example, one of the magnetic elements 34, 36 may be made of a ferromagnetic material. As an alternative, the magnetic element 36 may be omitted. In such a case, one of the magnetic elements 34, 48 may be made of a ferromagnetic material. It should also be understood that two bores 30 may be defined in opposite sides of the projection 22, and two respective locking elements 32 may be movably disposed in the two bores 30. In such a case, two locking recesses 46 should be defined in opposite sides of the guide cavity 44.

Figure 4:
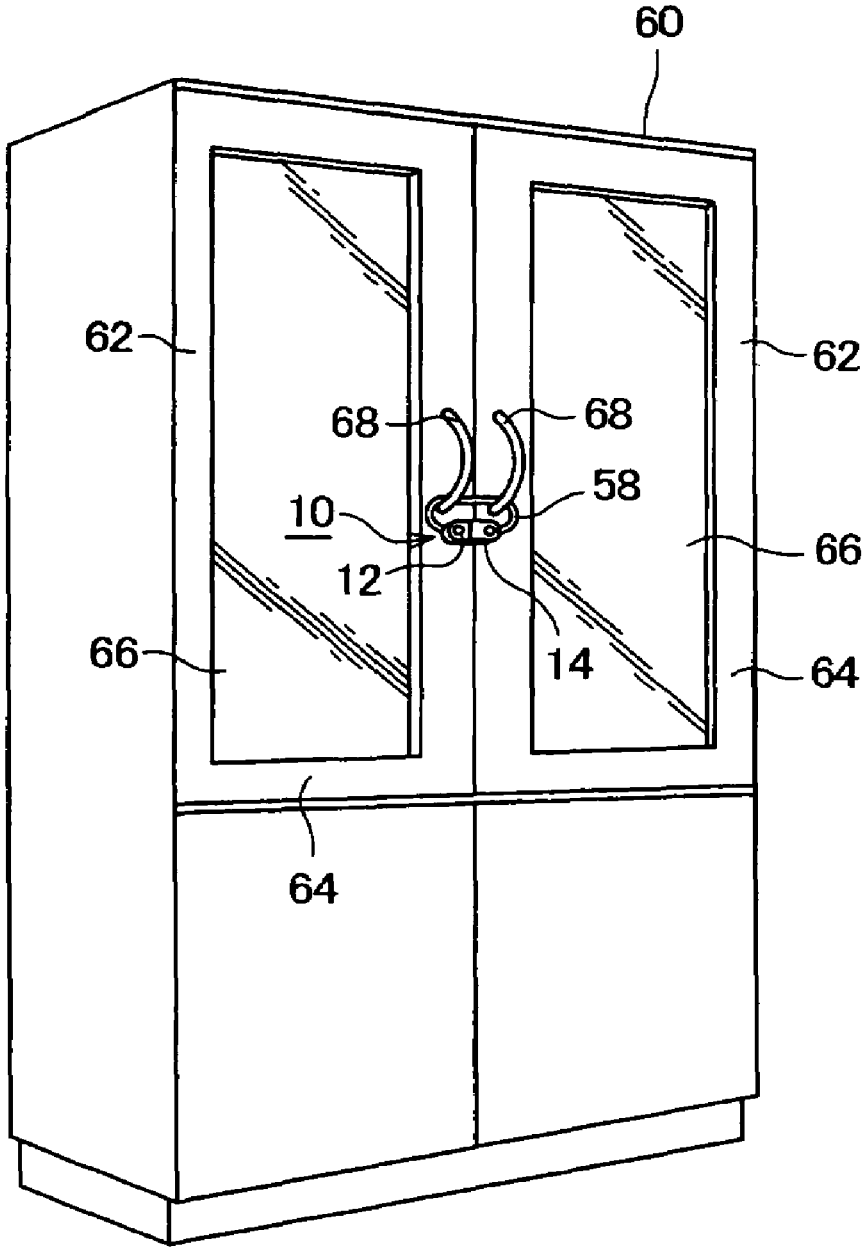
FIG. 4 is a perspective view of a wood cabinet wherein the locking mechanism shown in FIGS. 1 to 3 is used to lock the front doors of the cabinet.

FIG. 4 shows the manner in which the locking mechanism 10 shown in FIG. 1 to 3 is used to lock the front doors of a cabinet so as to prevent accidental opening of the front doors which may occur, for example, during earthquakes. Referring back to FIGS. 1 to 3, the male body 16 has a through aperture 54 in its round end 20. Similarly, the female body 38 has a through aperture 56 in its round end 42. As shown in FIG. 4, an elongated member or rope 58 has one end connected to the round end 20 of the male body 16 through the aperture 54 and the other end connected to the round end 42 of the female body 38 through the aperture 56. A wood cabinet 60 has a pair of rectangular front doors 62, 62. Each of the doors 62, 62 includes a rectangular wood frame 64 and a glass plate 66 fit within the wood frame 64. An arcuate knob 68 has opposite ends fixedly secured to each of the frames 64, 64. To couple the front doors 62, 62 together, a selected one of the male and female sections 12, 14 is passed through the two arcuate knobs 68, 68. The selected section is then coupled to the other section as shown in FIG. 4.

Figure 5:
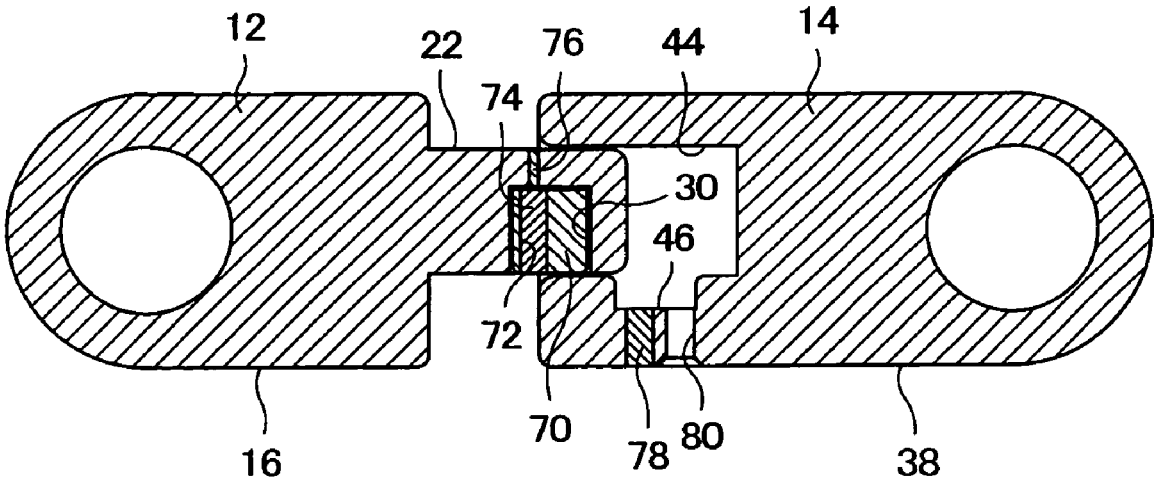
FIG. 5 is a sectional view of a modified form of the locking mechanism shown in FIGS. 1 to 3.
Figure 6:
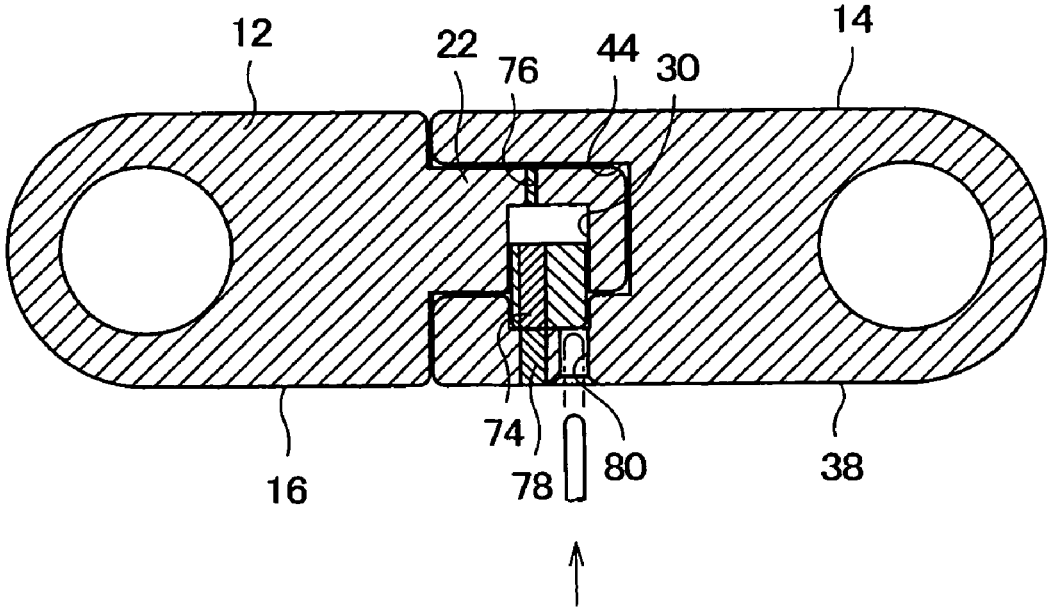
FIG. 6 is a view similar to that of FIG. 5, but showing that the locking mechanism is held in its locked position.

FIGS. 5 and 6 illustrate a modified form of the locking mechanism 10 shown in FIGS. 1 to 3. Like elements are given like reference numerals used in FIGS. 1 to 3 and will not be described herein.

In this embodiment, a locking element 70 has a through hole 72. A magnetic element or permanent magnet 74 is embedded within the through hole 72 and extends through the locking element 70. The magnet 74 is in the form of a rectangular pin. The magnet 74 has exposed opposite ends substantially flush with respective opposite ends of the locking element 70. A magnetic element or permanent magnet 76 is also embedded in the projection 22 adjacent to the bottom of the bore 30. As in the previous embodiment, the permanent magnet 76 has a polarity opposite to that of the permanent magnet 74. The permanent magnets 74, 76 are operatively associated with one another so as to hold the locking element 70 in place within the bore 30.

A magnetic element or permanent magnet 78 is embedded in the female body 38 adjacent to the bottom of the locking recess 46 and extends between the locking recess 46 and the adjacent outer surface of the female body 38. The magnet 78 has a polarity opposite to the magnet 74. The magnet 78 has the same polarity as the magnet 76, but has a greater magnetic force than the magnet 76. A through access opening 80 is defined in the female body 38 and communicated with the locking recess 46. The access opening 80 extends parallel to the permanent magnet 78. The access opening 80 has a diameter smaller than the diameter or width of the locking recess 46. As shown better in FIG. 6, all the three magnets 74, 76, 78 lie on a common straight line when the locking element 32 is placed in its locked position. All the three magnetic elements 74, 76, 78 are permanent magnets as in the previous embodiment. It should be understood that either one of the magnetic elements 74, 76 may be made of a ferromagnetic material. As an alternative, the magnetic element 76 may be omitted. In such a case, one of the magnetic elements 74, 78 may be made of a ferromagnetic material. Operation of this embodiment is substantially identical to that of the previous embodiment and will not be described herein.

Figure 7:
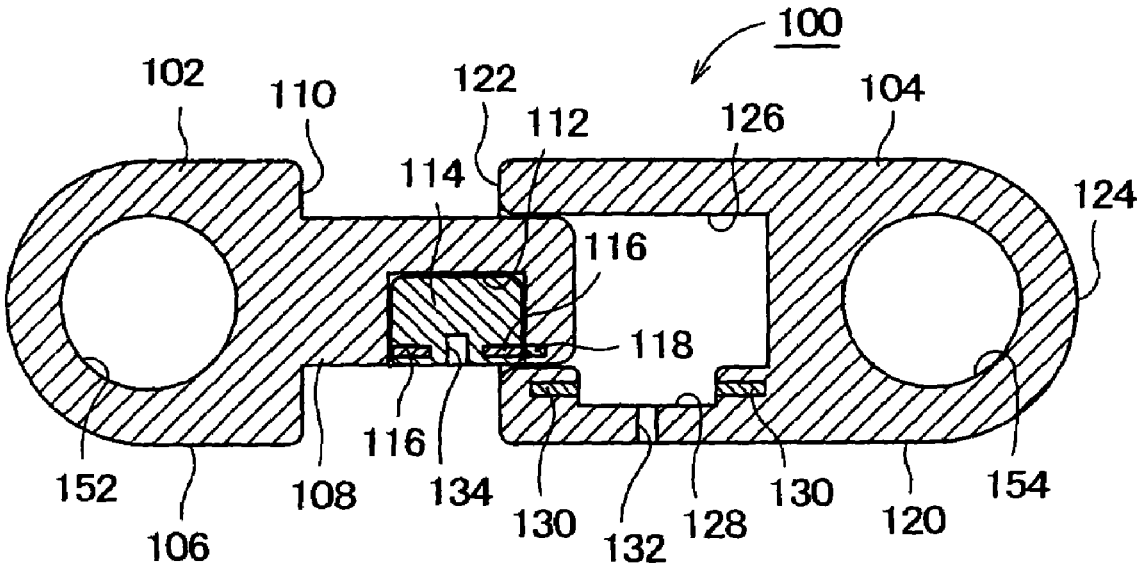
FIG. 7 is a sectional view of a magnetically actuated locking mechanism according to another embodiment of the present invention.
Figure 8:
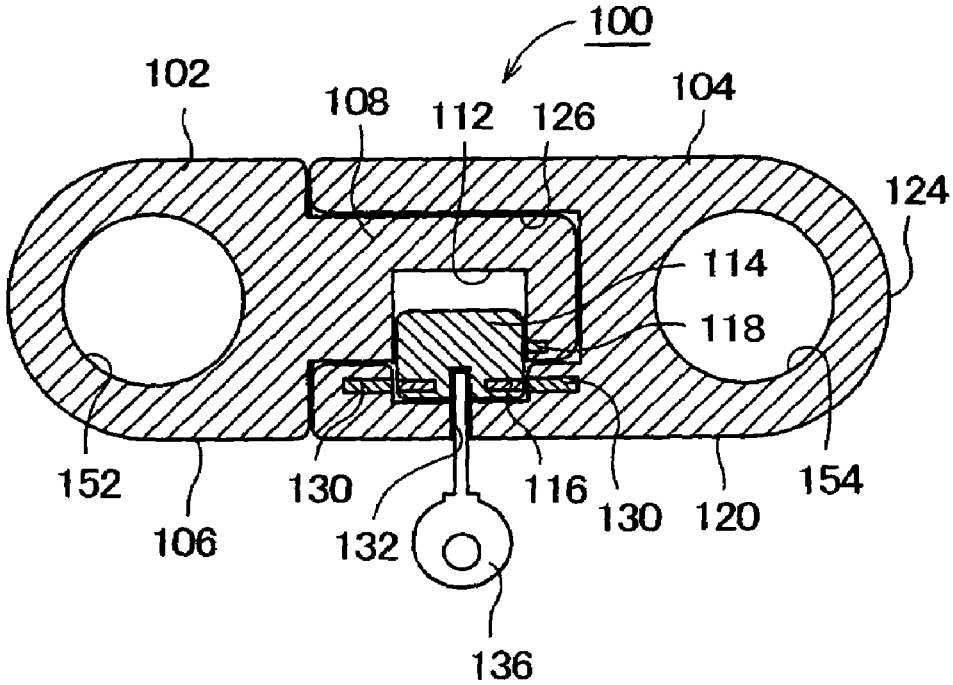
FIG. 8 is a view similar to that of FIG. 7, but showing that the locking mechanism is held in its locked position.

Referring to FIGS. 7 and 8, there is illustrated a locking mechanism, generally designated as at 100, according to another embodiment of the present invention. The locking mechanism 100 generally includes a male section 102 and a female section 104 releasably coupled to the male section 102.

The male section 102 includes a male body 106 and a projection 108. The male body 106 is generally circular in shape, but has a flat end 110. The projection 108 extending from the flat end 110 of the male body 106. A rectangular bore 112 is defined in one side of the projection 108. The bore 112 extends in a direction substantially perpendicular to the direction in which the projection 108 extends. A rectangular locking element 114 is movable between an unlocked position wherein the locking element 114 is fully received within the bore 112 as shown in FIG. 7 and a locked position wherein the locking element 114 is partly extracted from the bore 112 as shown in FIG. 8. A pair of magnetic elements or permanent magnets 116, 116 are embedded in opposite sides of the locking element 114. The exposed outer end of each of the permanent magnets 116, 116 is substantially flush with the adjacent side surface of the locking element 114. To hold the locking element 114 within the bore 112, a magnetic element or permanent magnet 118 is embedded in the free end of the projection 108 adjacent to the bore 112, as in the embodiment shown in FIGS. 1 to 3. The permanent magnet 118 has a polarity opposite to that of the permanent magnets 116, 116. When the locking element 114 is placed in its unlocked position as shown in FIG. 7, the permanent magnet 118 is aligned with and faces against one of the permanent magnets 116, 116 so as to hold the locking element 114 in place within the bore 112. It should be understood that two magnets 118 may be embedded in the projection 108 so that the two magnets are operatively associated with the respective two magnets 116, 116 to hold the locking element 114 in place.

The female section 104 includes a generally rectangular female body 120 with a flat end 122 and an opposite, round end 124. A rectangular guide cavity 126 is formed in the female body 120 and extends from the flat end 122 toward the round end 124 of the female body 120. The guide cavity 126 is dimensioned to receive the entire projection 108 when the flat end 110 of the male body 106 is brought into contact with the flat end 122 of the female body 120. A rectangular locking recess 128 is defined in one side of the guide cavity 126 and communicated with the guide cavity 126. The depth of the locking recess 128 is less than the length of the locking element 114 so that when the locking element 114 is placed in the locked position as shown in FIG. 8, the inner half of the locking element 114 remains in the bore 112 while the outer half of the locking element 114 fills the locking recess 128.

A pair of magnetic elements or permanent magnets 130, 130 are embedded in the female body 120 and located at opposite sides of the locking recess 128. The magnets 130, 130 have a polarity identical to that of the magnet 118, but have a greater magnetic force than the magnet 118. The magnets 130, 130 have a polarity opposite to that of the magnets 116, 116. With this arrangement, the locking element 114 is brought into alignment with the locking recess 128 when the projection 108 reaches the bottom of the guide cavity 126. The magnets 116, 116 are then attracted to the respective magnets 130, 130. This causes the locking element 114 to be partly extracted from the bore 112 and lockingly engaged within the locking recess 128. With the locking element 128 in its locked position, the magnets 116, 116 are aligned with and attracted to the magnets 130, 130 to hold the locking element 114 in place within the locking recess 128.

In this particular embodiment, a key assembly may be used to lock the locking element 114 to the female body 120 in a conventional manner. As shown in FIGS. 7 and 8, a through key opening 132 is defined in the female body 120 adjacent to the locking recess 128 and extends between the locking recess 128 and the outer surface of the female body 120. The locking element 114 has a key slot 134 to receive a key 136 through the key opening 132. The key 136 is rotated in a clockwise direction so as to lock the locking element 114 to the female body 120. To unlock the locking element 114 from the female body 120, the key 136 is turned in a counterclockwise direction. The key 136 is thereafter pushed toward the locking element 114 to move the locking element 114 from the locked to unlocked position.

In the illustrated embodiments shown in FIGS. 7 to 8, all the magnetic elements 116, 116, 118, 130, 130 are in the form of permanent magnets. The invention is not limited to this embodiment. For example, one of the magnetic elements 116, 118 may be made of a ferromagnetic material. Alternatively, the magnetic element 118 may be omitted. In such a case, a selected pair of the magnets 116, 116 and the magnets 130, 130 may be made of a ferromagnetic material.

Figure 9:
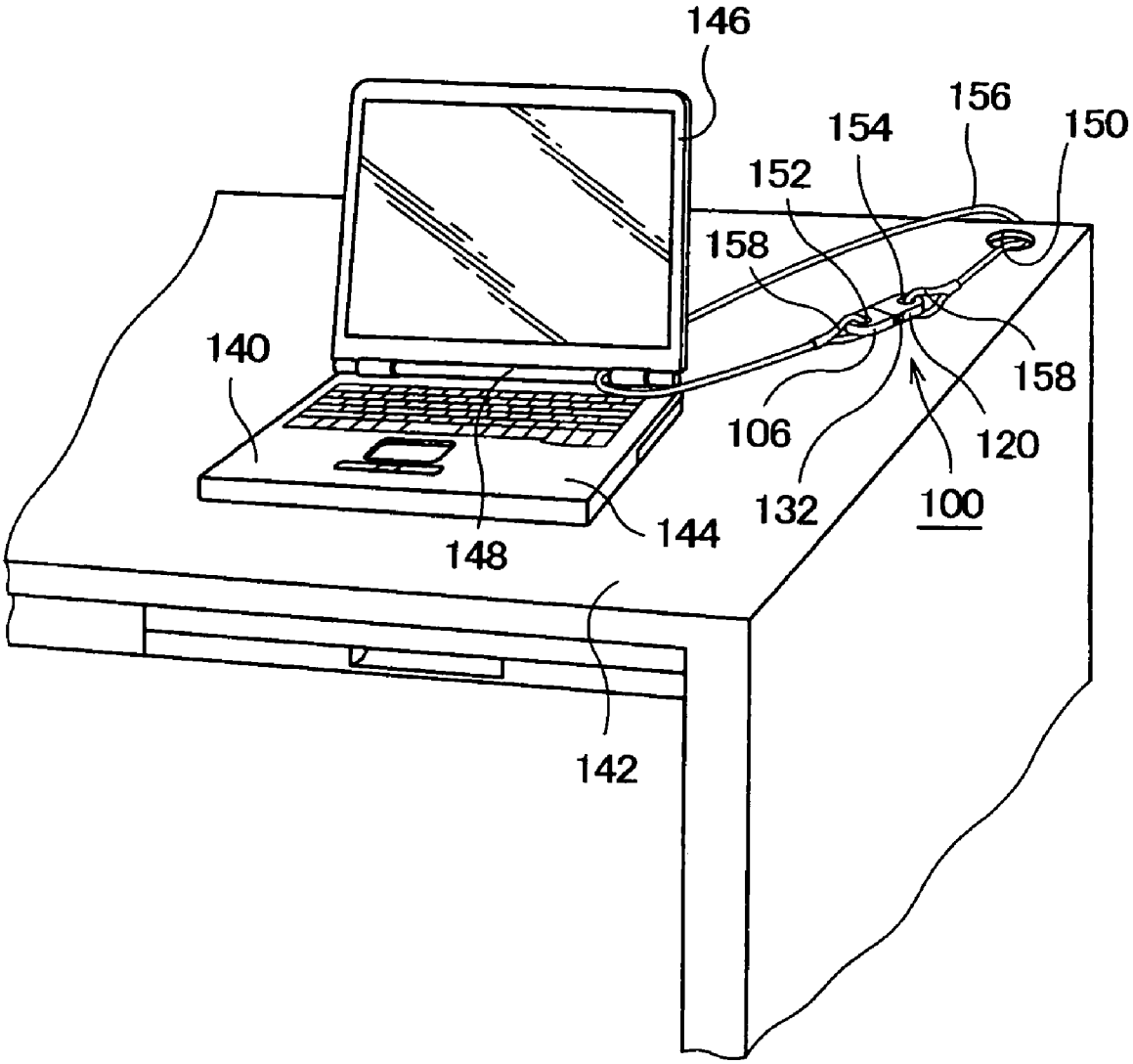
FIG. 9 shows the manner in which the locking mechanism shown in FIGS. 7 and 8 is used to lockingly connect a personal computer to a display table in a computer shop.

FIG. 9 shows the manner in which the locking mechanism 100 shown in FIGS. 7 and 8 is used to lock, for example, a personal computer to a display table in a computer shop. Specifically, a personal computer 140 is placed on a display table 142 and has a body 144 and a lid 146 hingedly connected to the body 144. When the lid 146 is opened as shown in FIG. 9, a space 148 is formed between the lower end of the lid 146 and the rear side of the body 144. A through opening 150 is defined in the display table 142 near one corner of the top. As shown in FIGS. 7 and 8, the male body 106 has a through aperture 152 in its round end. Similarly, the female body 120 has a through aperture 154 in its round end. An elongated member or rope 156 has a pair of looped ends 158 engaged with the respective apertures 152, 154. To lock the computer 140 to the display table 142, a selected one of the male and female sections 102, 104 is passed through the through opening 150. The other section is then passed through the space 148 between the body 144 and the lid 146 of the computer 140. Thereafter, the both sections 102, 104 are coupled together. This coupling can readily be made by inserting the projection 108 of the male body 106 into the guide cavity 126 of the female body 120. Then, the locking element 114 is automatically urged into its locked position. The key 136 is inserted into the key slot 134 through the key opening 132. The key 136 is turned in a clockwise direction to lock the male section 102 to the female section 104. The key 136 is thereafter pulled out of the key slot 134.

Although the present invention has been described with respect to its preferred embodiments, it is to be understood that various modifications and changes may be made without departing from the scope of the invention as claimed. For example, the male and female bodies are shown as being rectangular in shape. Alternatively, the male and female bodies may take any other shapes. For example, the male and female bodies may have a cylindrical shape. Similarly, the projection may be in the form of a circular or semicircular cylinder. In the illustrated embodiment shown in FIGS. 1 to 3, the rectangular magnet is embedded in the locking element. As an alternative, the magnet may extend around the locking elements. In such a case, the corresponding magnet in the female section may extend around the locking recess.

What is claimed is:

1. A magnetically actuated locking mechanism comprising:

a male section including a male body, a projection extending from said male body, said projection including a bore extending in a direction transverse to the direction in which said projection extends, and a locking element movable between an unlocked position wherein said locking element is received within said bore and a locked position wherein said locking element is partly extracted from said bore, said locking element including at least one first magnetic element; and a female section including a female body having a guide cavity extending in a first direction and dimensioned to receive said projection, a locking recess extending in a second direction transverse to said first direction and dimensioned to lockingly receive said extracted part of said locking element, and at least one second magnetic element located adjacent to said locking recess, and said at least one first magnetic element and said at least one second magnetic element being operatively associated with each other to magnetically urge said locking element from said unlocked position to said locked position when said locking element is substantially aligned with said locking recess after said projection is inserted into said guide cavity.

2. A magnetically actuated locking mechanism according to claim 1, wherein said at least one first magnetic element and said at least one second magnetic element are permanent magnets of opposite polarities.

3. A magnetically actuated locking mechanism according to claim 1, wherein one of said at least one first magnetic element and said at least one second magnetic element is a permanent magnet, and the other magnetic element is made of a ferromagnetic material.

4. A magnetically actuated locking mechanism according to claim 1, wherein said female body includes a through access opening through which said locking element held in said locked position is accessible from outside of said female body, said through access opening being less in diameter than said locking recess.

5. A magnetically actuated locking mechanism according to claim 4, further comprising a release member insertable through said access opening so as to move said locking element from said locked position to said unlocked position.

6. A magnetically actuated locking mechanism according to claim 1, wherein said at least one first magnetic element extends in a direction substantially identical to the direction in which said projection extends, when said locking element is held in said unlocked position.

7. A magnetically actuated locking mechanism according to claim 1, wherein said at least one first magnetic element extends in a direction transverse to the direction in which said projection extends, when said locking element is held in said unlocked position, and said at least one first magnetic element and said at least one second magnetic element lie on a common straight line when said locking element is held in said locked position.

8. A magnetically actuated locking mechanism according to claim 1, further comprising two first magnetic elements embedded in opposite sides of said locking element and extending in a direction substantially identical to the direction in which said projection extends, and two second magnetic elements embedded in said female body and located at opposite sides of said locking recess, said two first magnetic elements being aligned with said respective two second magnetic elements to hold said locking element in said locked position.

9. A magnetically actuated locking mechanism according to claim 8, further comprising at least one third magnetic element embedded in said projection, said at least one third magnetic element being aligned with one of said two first magnetic elements when said locking element is placed in said unlocked position within said bore.

10. A magnetically actuated locking mechanism according to claim 1, wherein said bore has a depth, and said locking element has a length substantially identical to said depth of said bore, said locking recess having a depth less than said length of said locking element.

11. A magnetically actuated locking mechanism according to claim 1, wherein said male body has a flat end and an opposite end, said male body having a through aperture in said opposite end, and said female body has a flat end releasably connected to said flat end of said male body and an opposite end, said female body having a through aperture in said opposite end.

12. A magnetically actuated locking mechanism according to claim 11, further comprising an elongated member having opposite ends connected to said opposite ends of said male and female bodies through said respective through apertures.

13. A magnetically actuated locking mechanism comprising:

a male section including a male body, a projection extending from said male body, and including a bore extending in a direction transverse to the direction in which said projection extends, and a locking element movable between an unlocked position wherein said locking element is received within said bore and a locked position wherein said locking element is partly extracted from said bore, said locking element including at least one first magnetic element; and a female section including a female body having a guide cavity extending in a first direction and dimensioned to receive said projection, a locking recess extending in a second direction transverse to said first direction and dimensioned to lockingly receive said extracted part of said locking element, and at least one second magnetic element located adjacent to said locking recess, and said at least one first magnetic element and said at least one second magnetic element being operatively associated with each other to magnetically urge said locking element from said unlocked position to said locked position when said locking element is substantially aligned with said locking recess after said projection is inserted into said guide cavity;

wherein said projection comprises at least one third magnetic element, said at least one third magnetic element being attracted to said at least one first magnetic element to hold said locking element in said unlocked position.

14. A magnetically actuated locking mechanism according to claim 13, wherein said at least one third magnetic element is made of a ferromagnetic material, and said at least one first magnetic element and said at least one second magnetic element are permanent magnets of opposed polarities.

15. A magnetically actuated locking mechanism according to claim 13, wherein said at least one first magnetic element is made of a ferromagnetic material, and said at least one second magnetic element and said at least one third magnetic element are permanent magnets, said at least one second magnetic element having a greater magnetic force than said at least one third magnetic element.

16. A magnetically actuated locking mechanism according to claim 13, wherein said at least one first magnetic element is a permanent magnet, and said at least one second magnetic element and said at least one third magnetic element are permanent magnets having a polarity opposite to that of said at least one first magnetic element, said at least one second magnetic element having a greater magnetic force than said at least one third magnetic element.

* * * * *